US005425433A

United States Patent [19]

Huber

[11] Patent Number: 5,425,433

[45] Date of Patent: Jun. 20, 1995

[54] ELEVATING APPARATUS

[76] Inventor: Josef A. Huber, Burggrabenstrasse 20, CH 8280 Kreuzlingen, Switzerland

[21] Appl. No.: 208,875

[22] Filed: Mar. 10, 1994

[51] Int. Cl.[6] ..... B66B 9/20

[52] U.S. Cl. ..... 187/225; 187/243; 182/145

[58] Field of Search ..... 187/225, 242, 243, 244, 187/231, 240; 182/145, 63; 414/742

[56] References Cited

U.S. PATENT DOCUMENTS 3,666,046 5/1972 Meinecke, Jr. ..... 187/225

4,270,629 6/1981 Bergling ..... 187/225

*Primary Examiner*—Kenneth W. Noland

*Attorney, Agent, or Firm*—Martin A. Farber

[57] ABSTRACT

An elevating apparatus comprises a rack (1) supporting the apparatus, and an elevating platform (7) adjustable in height and suitably guided by at least one mast (8) or column. The mast (8) may be moved from a transport position into an operating position by having it pivoted about a horizontal tilting axis (9) on the rack (1). The axis (9) is arranged at the end of two parallel beams (2) of the rack (1) so as to enable the mast to be folded between these beams (2), thus practically requiring no additional space during transport.

25 Claims, 6 Drawing Sheets

Fig.5A
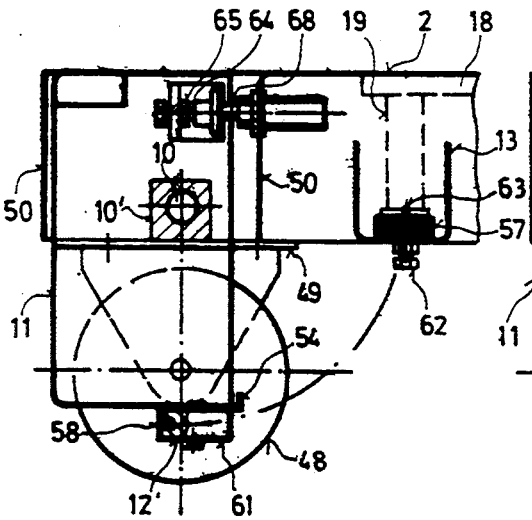
Fig.5B
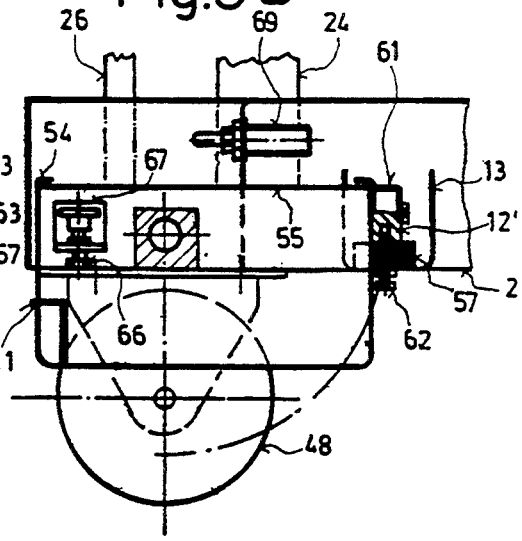
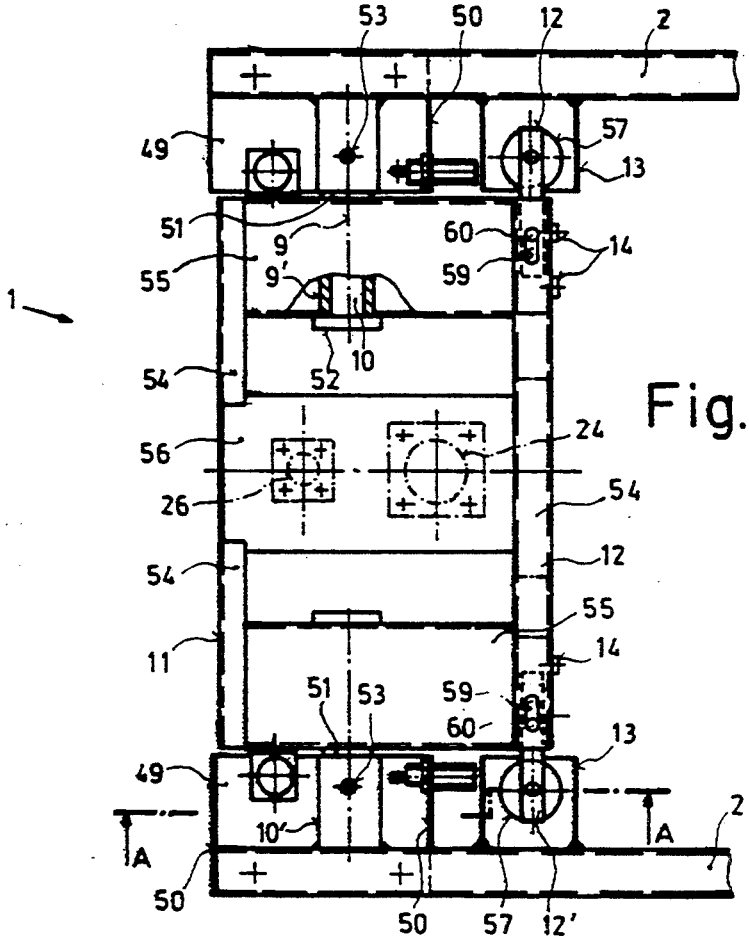
Fig.5C

ELEVATING APPARATUS

FIELD OF THE INVENTION

This invention relates to an elevation apparatus of the type which uses a rack or frame of generally rectangular shape so as to have two opposing longitudinal sides parallel to each other as well as two transverse sides which are also parallel to each other and extend substantially perpendicularly to the longitudinal sides. This rack supports a mast or pole onto which a platform is displaceably mounted so as to be able to be moved along the mast into different heights. In order to enable an easy transport of this apparatus, the mast or pole is tiltably mounted about a horizontal tilting axis on the rack so as to be tilted selectively into a transport position folded to the rack and into an operating position in which it forms an angle with the rack and stands generally in an upright position, preferably perpendicular to the plane of the rack.

As used herein, the term platform is intended to encompass in general an arrangement which enables a person to stand on it and to be raised and lowered with it. The term "mast", as used herein, shall mean any means which may be errected to serve as a guide for the platform and may either comprise a single pole, as is preferred, or two poles or may even be in the shape of a portal.

BACKGROUND OF THE INVENTION

A variety of elevating apparatuses of this type are known. An example may be found in EP-A-0 403 410. Such devices are employed in workshops and factories where they are more or less bound to the area of the respective workshop or factory. Often it would, however, be desirable to have such device available at a distant workplace, e.g. to have it available for services or repairs at a client or at a construction site. The disadvantage of most of the elevating devices of the prior art, as also of the construction of EP-A-0 403 410, is that the rack necessarily forms an angle with the mast construction, and is in most cases perpendicular, thus rendering the elevating device quite bulky and hardly suited for transportation, especially in a vehicle of limited space, such as a van or a small delivery truck as is frequently used by the service personal.

It is true that it is known from EP-A-0 443 843 to construct an elevating apparatus, and particularly a mast, with all features mentioned in the introduction from individual parts to be plugged into one another. The rack has some relatively short protruding upright plug sockets on its upper surface into which the individual parts of a mast telescopically displaceable in height may be plugged in. The mast has an elevating platform secured to its uppermost portion, This design, however, has numerous disadvantages:

The plug sockets have to exhibit a certain minimum height. This adds in a certain way to the bulkiness of the construction.

Of course, the plug sockets may be made as short as possible to avoid to long protruding parts; but if they are made short, then a secure guidance and mounting of the other parts of the mast to be plugged in is not ensured. On the one hand the individual parts must have a certain tolerance or clearance in order to be able to plug the parts into one another. On the other hand, the plugged mast parts should fit into the plug sockets as close as possible in order to avoid unsure and unsteady mounting of the same. It is true that there are additional mounting brackets provided in the construction of the EP-A- to improve the stability of the mast, but they extend almost parallely to the mast so as to be unable to improve stability.

The individual parts of the mast have to be taken separately during travelling which is not only unconvenient, but results also in several loseable pieces.

Finally it not just an advantage if the elevating platform ist rigidly mounted at the top of the mast, because the top part of the mast can only be lowered to the extent that its bottom end props against the rack. Therefore, even in the lowermost position of the mast, the elevating platform will be relatively relatively high so that a ladder will be necessary (in addition) to be able to climb onto the platform.

An apparatus according to the above introduction is also known from CH-A-504379 or DE-C-2227470. In both cases, the rack is provided with supports raising from the beams or spars of the frame about in its center and bearing the tilting axis. This design is relative expensive and bulky. In case of a transport, the parts have to be dismounted so that handling is difficult and time consuming. Moreover, the dismounted parts have to be taken along as separate, and possibly loseable parts.

SUMMARY OF THE INVENTION

It is therefore an object of the present invention to construct an elevating appartus, having all the features mentioned in the introduction, in such a manner that transportation and handling is facilitated, but simultaneously also increasing safety.

This object is achieved in accordance with the present invention by using a generally rectangular rack with two longitudinal sides and two transverse sides and virtually consisting only of at least three beams which define a plane (neglecting the fact that each beam has a certain thickness or height). The tilting axis extends within this thickness beween two of the beams and is arranged adjacent one end of the longitudinal beams or forms the transverse side itself.

By the inventive construction a plurality of problems are eliminated all at once:

The mast is fixed to the rack and can not be get lost;

the mast can be folded to a completely flat configuration at least virtually without any protruding part, and can be easily transported by tilting the mast into the transport position, because the tilting axis is situated in the end region of the beams and at least the major part of the mast, preferably the whole mast, can extend between the longitudinal beams of the frame;

since tolerances and clearances can be kept relatively narrow, safety is increased with respect to a plugged construction and the risk of an unsteady, shaking mast is avoided;

with the flat type of construction, the elevating apparatus is easier to transport, even in a relatively small van, without the need of dismounting it, and it can also easier be climbed.

It is especially preferred if at least two parallel ones of the beams of the frame have a telescopic construction as to enable an extension of the frame. On the one hand, this permits an improved and a more secure holding of the mast in its transport position where it will usually extend over the whole length of the rack. On the other hand, it enables the rack to be telescoped to a size as small as possible. Finally, there is also the possibility to make use of this telescopic extensibility for increasing the base area in use in order to enhance the stability. In this case, it is not necessary for a rack of unequal length and width (i.e. a rectangle) that only the longitudinal sides are telecopically extensible; to the contrary, alternatively or in addition, it is also conceivable to make the side of the width, i.e. the smaller side, extensible in order to enlarge the base area, for instance to secure the rack against tilting. This is of particular importance if the platform shall be constructed rotatably or pivotally around the mast in order to reach surfaces to be worked which can hardly be reached otherwise.

A particularly favorable embodiment of the invention provides a locking means for the mast. Of course, it could be formed in any desired manner according to the prior art, but locking is facilitated if a transverse beam of the frame interconnects the telescopic beams and has a recess forming a cross-section with a projecting portion to engage said mast in transport position of the same to lock it. But for locking purposes, it is also of advantage if the tilting axis comprises a prism means having a longitudinal axis and including means defining a journal bearing to enable pivoting movement about a pivot axis which is substantially coincident with the longitudinal axis wherin the prism supports the mast which extends perpendicularly to said prism means. For a prismatic body forming or bearing the tilting axis so that its outer surfaces have a certain radial distance from the axis enables safer locking without the need that the locking device has to engage the mast itself which may be undesirable in some cases. Moreover, this construction permits to have a hollow mast which leads to a smaller weight for transportation and, in addition, can be used as a housing for incorporation of parts to be protected, particularly of a drive for moving the platform along the length of the mast or of cables and lines.

BRIEF DESCRIPTION OF THE DRAWINGS

Further details and advantages of the invention will become apparant from the following description with reference to the accompanying drawings in which:

FIG. 1*a* shows an elevating apparatus according to the invention in an axonometric representation in its operating position to which

FIGS. 3 show a first embodiment of a mast structure together with an automatic drive for elevating the platform, the mast being in its retracted position in FIG. 3A, while FIG. 3B depicts the extended position, to which FIGS. 5*a*–5*c* show details of an U-shaped frame, the fourth beam (a transverse beam) of which is replaced by a prism structure supporting the mast, wherein Part A of FIGS. 5 is a fragmentary section along the line A—A of FIG. 5C in transport position of the mast and its prism structure, whereas FIG. 5B is a similar representation, but in operating position, the parts of the mast being omitted.

DETAILED DESCRIPTION OF THE DRAWINGS

Figure 1A:
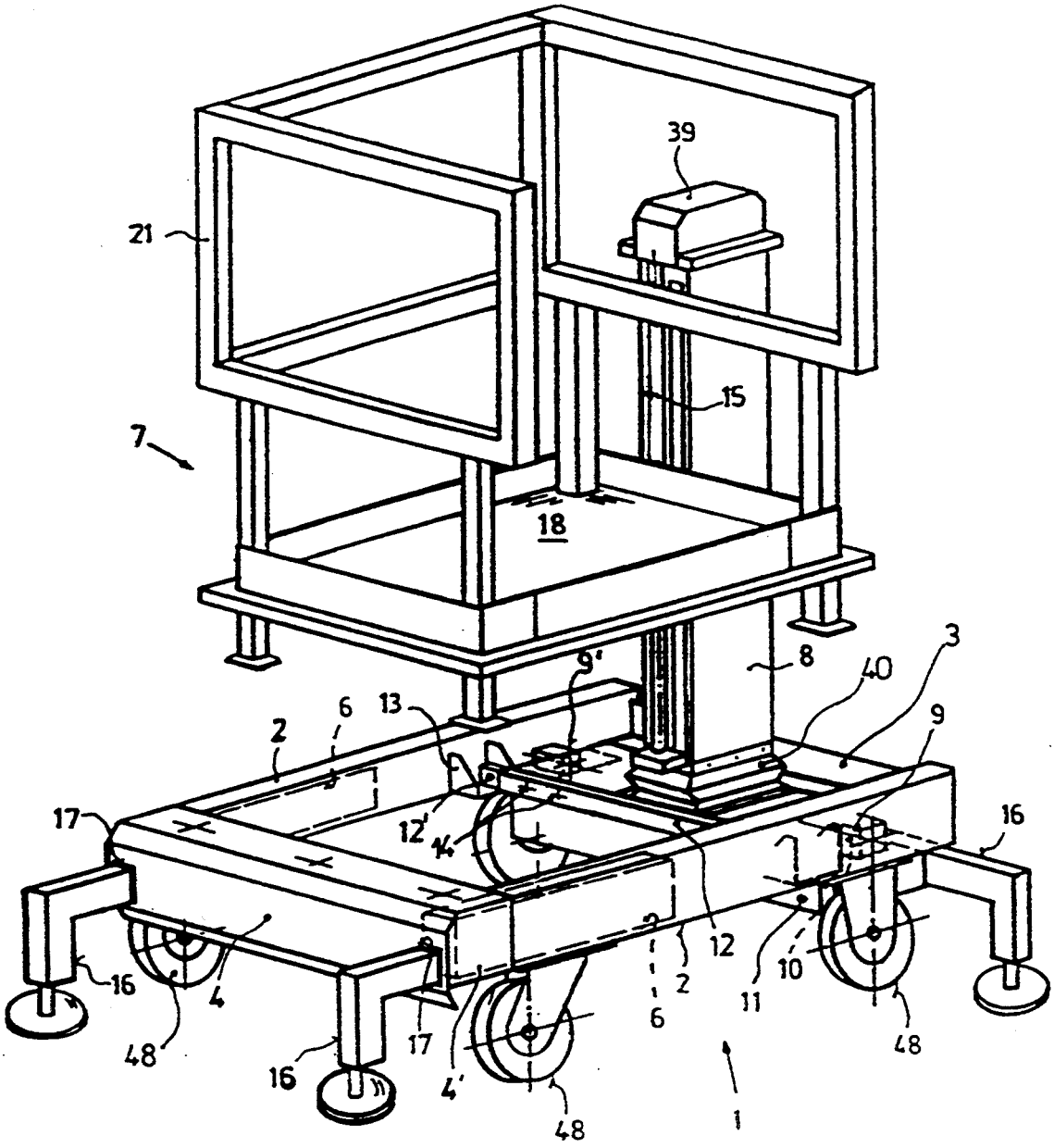
Figure 1B:
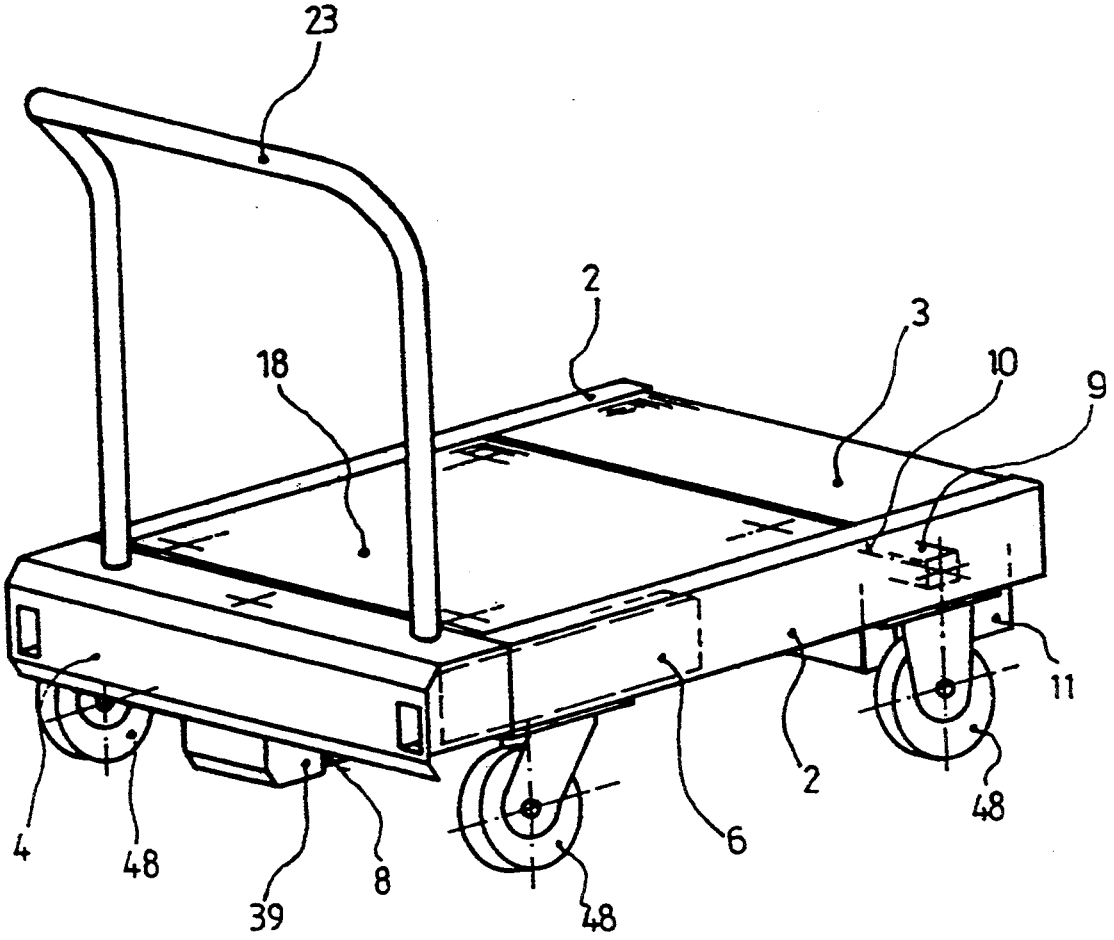
FIG. 1*b* illustrates a similar representation, but in transport position.

In FIGS. 1*a* and 1*b*, there is a frame-like rack 1 of generally rectangular shape. Accordingly, the rack has two longitudinal beams 2 connected to each other by a pair of transverse beams 3, 4. As can be seen, the rack or frame 1 moveable on rolls 5 which is preferred although not necessary within the scope of the invention. As is indicated in broken lines, the longitudinal beams 2 are preferably formed as hollow tubes of square cross-section at least over part of their length for guiding each a guide beam 6 which extends into their interior, the guide beams 6 being secured to the transverse beam 4 to form an extensible telescopic guide. In this way, the transverse beam 4 may be drawn from the position shown (assumed during transport of the elevating appartus shown to a distant working place), with respect to FIG. 1, out to the left, e.g. for increasing the base area of the rack 1.

It is to be understood that also other beams of the rack 1, such as the longitudinal beams 2 and/or der transverse beam 3, may be made telescopically extensible for the latter purpose.

Telescopic extensibility of the transverse beam 4 may, however, have yet another purpose. For a mast 8, which forms a guidance for an elevating platform 7, is mounted on the rack 1 in pivotal manner about a tilting axis 9 to be tilted by about 90° out of the operating position shown, in which it forms an angle, particularly of 90°, with the relatively flat frame 1 defining a substantially horizontal plane (say the middle plane of the rack 1), in such a way that it assumes a position between the longitudinal beams 2, thus, lying in the same plane. Since the mast has finite cross-sectional dimensions, it should be somewhat shorter in order to pass the transverse beam 4 during tilting movement. Shorting of the mast can, however, be avoided by making the trasnverse beam 4 telescopically extensible, at least by a small length, to allow the mast to pass.

The beams 2–4 define virtually a single plane if one neglects that they have acertain finite thickness or height. In this plane, also the tilting axis 9 is situated. If the mast 8 is pivoted about this tilting axis 9 into a transport position shown in FIG. 1*b*, it is situated in the plane defined by the beams 2–4, a platform 18 serving conveniently as a cover in this transport position so as to form a load surface. In this way, the rack 1 comprises no protruding parts whith exception of rolls 48, which may optionally be insertable into the rack 1, and, together with the mast, forms a unit which may easily accommodated within a van, a small delivery truck or even in a trunk of a normal car after folding the rear seats to be transported to any distant place. This will particularly be facilitated, if the unit or at least its main parts consist of a light material, especially light metal, such as aluminum profiles. For transportation to the place desired, some socket holes 70 may be provided in the transverse beam 4, as may be seen from FIG. 1*a*, to enable insertion of a handle bar 23 shown in FIG. 1*b* and securing the same by fastening means known per se (bolts, nuts, bayonet catch or the like), if necessary. In this way, the load platform may also be used to carry some load.

Figure 2:
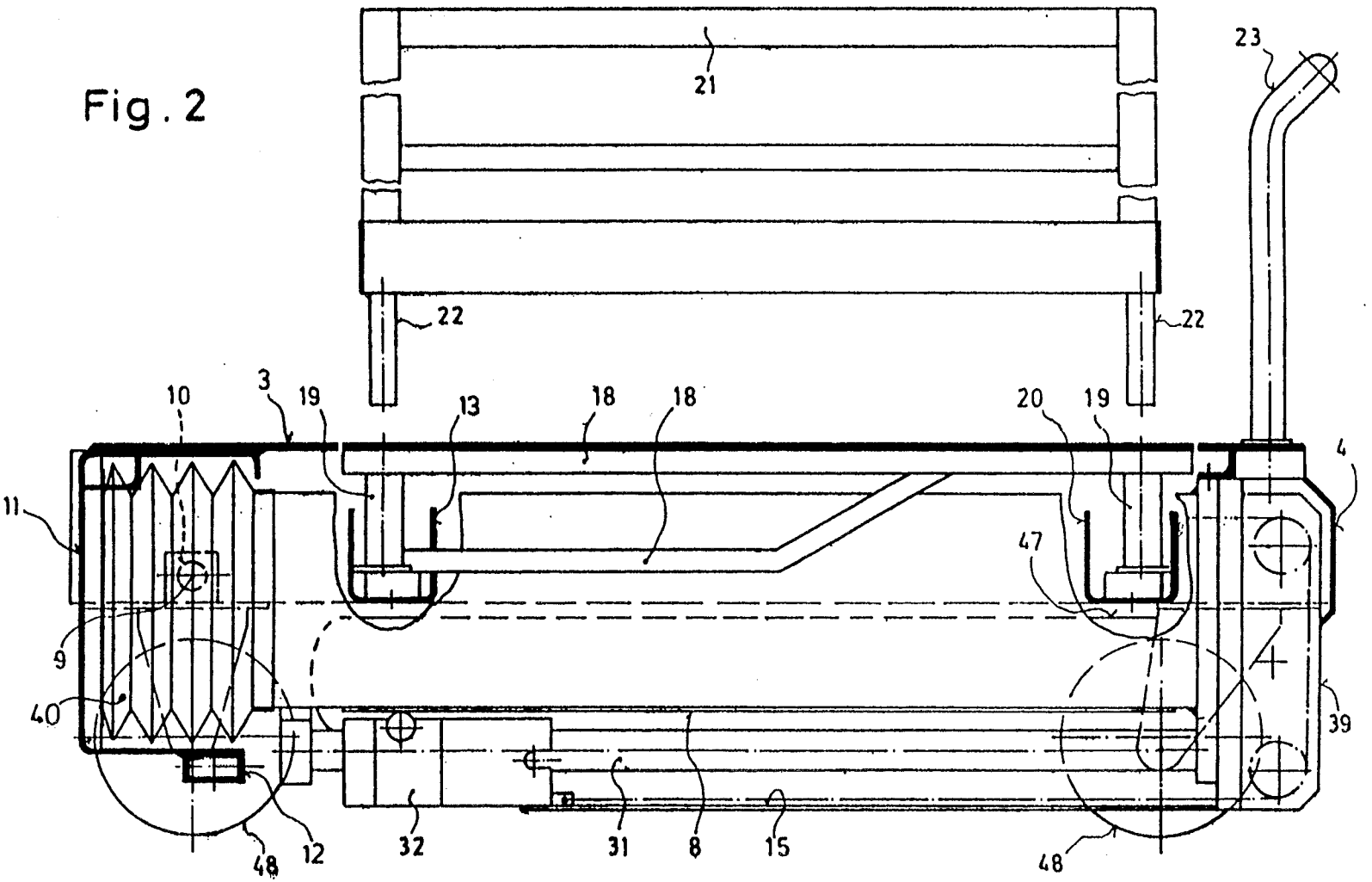
FIG. 2 is a longitudinal section through the frame-like rack of the apparatus.

According to a preferred embodiment, the construction may be such that the transverse beam 4 takes over a locking function for the mast 8 for locking it in its transport position shown in FIG. 1*b*. To this end, the trasnverse beam 4 comprises a cross-section with a protruding portion acting as a latch when the transverse beam is telescopically displaced to cover and receive the free end of the mast 8. For example the transverse beam 4 may be simply formed with an U-shaped cross-section open towards the interior of the frame 1 and towards the free end of the mast 8, as is indicated in dotted lines. FIG. 2 shows more clearly the transverse beam 4 covering the free head end of the mast 8 (provided with a cap 39) at least in part, thus preventing unintentional unfolding of the mast during transport.

Preferably a locking device is also assigned to the operating position of the mast 8, as shown. As is indicated in dotted lines, pivot bearings define the tilting axis adjacent the transverse beam 3 and are provided in both longitudinal beams 2 and receive each an an axle journal 10 (only one is visible). Each of the axle journals 10 projects from a front surface of a square prism body 11 which conveniently has a hollow interior so as to serve as a housing for some elements to be described later. However, it would likewise be possible to leave out one of the outer surfaces of the prism and to form only a U-shaped cross-section supporting the mast 8, the latter being mounted either on the outer or the inner side of the bottom of this U-profile. The axle journals need not be connected, e.g. welded, directly to the front surfaces of the prism or U-section 11, but it is also possible to provide bearing blocks 9' on either side of the prism 11 which blocks may receive cylindric axle journals in a similar manner as it is the case with corresponding bearing blocks on the frame 1 which are not shown, but will be discussed later with reference to FIG. 5.

At this point it should be emphasized that the tilting axis 9 is situated relatively closely to the transverse side formed by the transverse beam 3 of the frame 2–4 or, in other words, is arranged within the end region of the longitudinal beams 2. Therefore, if the frame 1 has an appropriate form stability, the transverse beam 3 can entirely be ommitted (vide FIG. 5), thus resulting in the advantage of a gain in space and weight which may be utilized to shift the tilting axis 9 completely to the end of the longitudinal beams 2 in order to allow for a still longer mast 8 and optionally to take over the function of ensuring the stability in transverse direction in the place of transverse beam 3.

The prism body 11, however, may also serve for locking purposes in an advantageous manner. To this end, several different possibilities would be conceivable., for example, by inserting a latch from the side of the longitudinal beams 2 into a corresponding latch opening of the prism body 11 (or vice versa). In the embodiment shown, however, a locking bar 12 is provided and located within a holder 13. The holder 13 may be relatively broad in order to enable tilting of the prism 11. While the holder in the embodiment shown has about the shape of a U open at its upper side to enable insertion of the bar 12, it would be likewise conceivable as a profile which is closed at the top side or as a slot guidance so that the bar is connected to the rack 1 without allowing to be lost.

In any case, a safe lock free from play could be provided by arranging at least one, preferably at least two, threaded holes 14 (only schematically indicated) in the locking bar 12 which are aligned with bores of the prism 11 so that in the op'erating position illustrated of the mast 8, screws may be screwed into the threaded holes 14 which secure the position in this manner. It is advantageous if such locking screws and holes 14 are arranged symmetrically to a middle axis extending between the longitudinal beams 2, i.e. conveniently at both ends of the locking bar 12.

In the embodiment shown, the mast 8 is formed with a box section lifting and lowering the elevating platform 7 by means of a chain 15 along a guidance to be described later in detail. It would also be conceivable to form the mast as a round pilar or column, mainly in order to allow pivoting of the elevating platform about which, however, would result in a displacement of weight. Such weight displacement may be buttressed by the telescopic construction of the frame parts 2–4 already mentioned, but it is also possible to provide supplementary feet 16. According to the prior art, such supplementary feet are pivotable about vertical pivot axes on the frame. This, however, results in a considerable load on the pivot axes and the bearing thereof which is at the expense of safety. Therefore, the feet 16 are formed as plug-in-parts to be inserted into openings 17 which construction enable a better distribution of forces over a longer distance. Optionally, the feet 16 may be mounted on round sections extending in the direction of the longitudinal beams 2 (or of the transverse beams 3 and 4) so as to permit pivoting the feet out of a transport position in which the portions of the feet 16, bend downwardly in FIG. 1, can be tilted into the plane of the frame 1 for transportation. In this way, the feet 16 would be connected to the frame 1 in an undetachable manner, although other constructions would likewise be possible. It would also be conceivable to provide brake shoes acting either onto the wheels 48 and/or onto the ground which may be lowered from the rack 1 to fix the rack 1 moving on the wheels 48, thus either replacing the feet 16 or being provided in addition to them.

It is to be understood that a rotating arrangement of the platform 7 about the longitudinal axis of the mast 8 may also be realized in such a manner that the mast 8 itself is supported rotatably about its longitudinal axis. This could either be effected by manual displacement and by fixing the respective rotational position, or by providing a rotational drive wherein a toothed turntable engaged by a pinion of a motor is mounted at the prism 11.

Figure 3A:
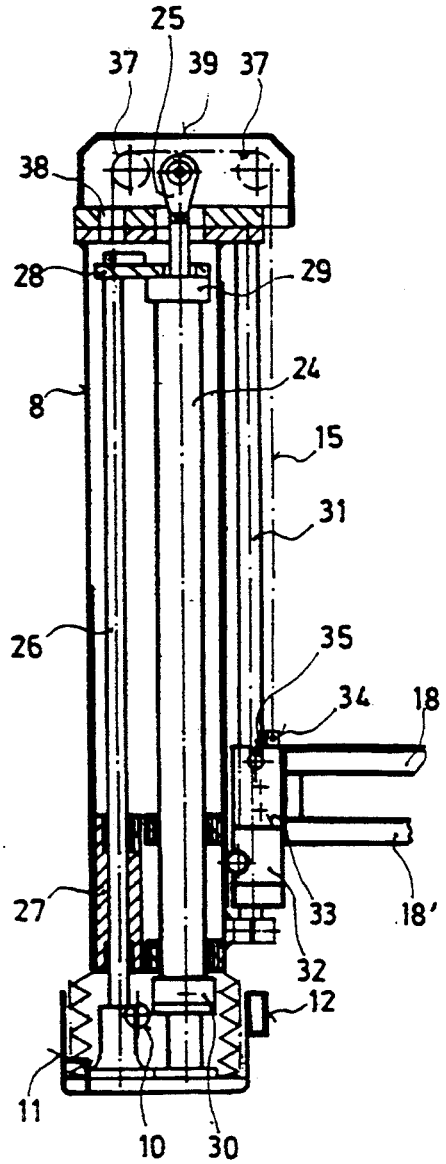
Figure 3B:
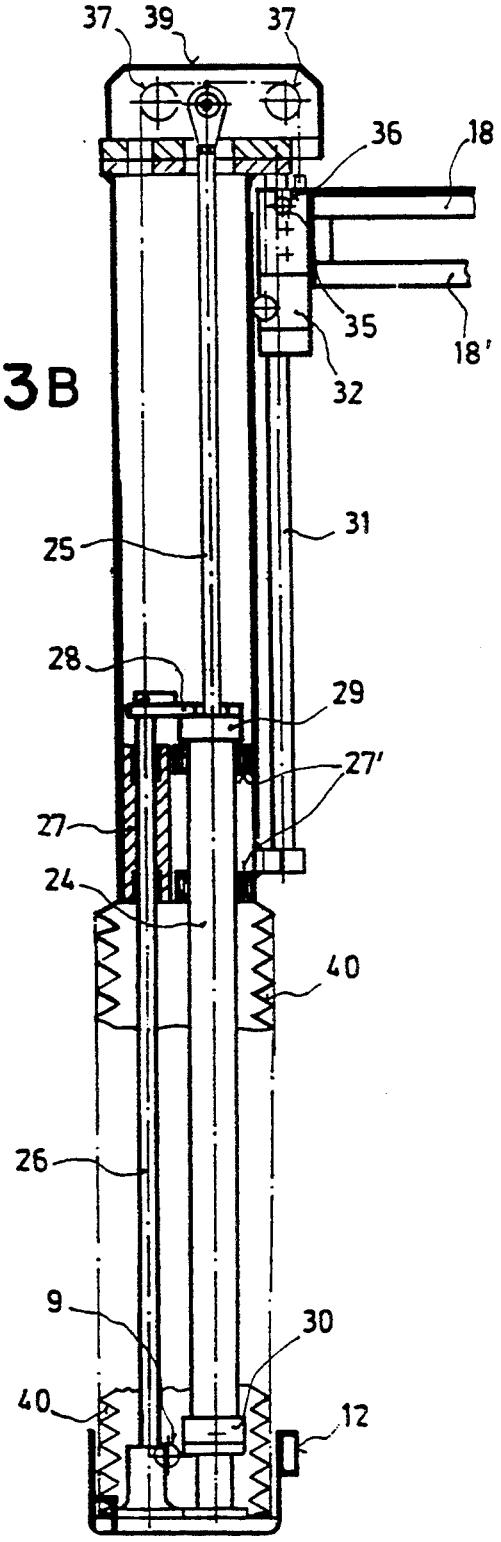

As may be seen from FIG. 1, the elevating platform 7 consists substantially of a platform member 18 optionally provided with touch down feet 19. These feet 19, in a transport position of the elevating platform as seen in FIG. 2, will stand onto U-shaped support profiles 20 defining the transport position in such a way that it is flush with the upper surface of the frame-like rack 1. It is advantageous to have a handrail 21 at the upper side of platform member 18, and this may be formed as a part to be plugged in, the feet 19 conveniently being formed as hollow socket profiles receiving plug shanks 22 of the handrail 21. Since, in the present embodiment, forces act unidiractionally onto the platform member 18, it is beneficial to provide at least one reinforcing strut 18', preferably several ones, e.g. parallely to each other. As may be seen from FIG. 3, this has, in the case of an aligned arrangement with a supporting surface 33, also the advantage that the strut 18' does not only reinforce the platform member 18, but also serves as a supporting surface for the platform membrer 18, as will be shown with reference to FIG. 3 later on.

Furthermore, the handle bar 23 mentioned above (conveniently also being detachable or plugged in) may be provided in order to move the elevating apparatus into any place desired, if it is not preferred to provide a drive for this task. In practice, it will be suitable, if a control appliance for some drives is mountable on the handrail 21 and is connected to its resspective drive or drives via lines laid either into the hollow mast 8 or into a separate guide tube so that it may easily be operated in every position of the elevating platform.

Although, for many applications, it might be sufficient to provide only a manual device for moving or adjusting the elevating platform 7 in height, for example by providing fixing devices for the respective height of the elevating platform 7 in regular distances along the mast, it may be desirable for other applications to provide an automatic drive for adjustment in height. It has already been mentioned that part of such a drive may be accommodated either within the mast 8 itself and/or in the prism 11, thus, achieving a protection against dust and fouling in a beneficial way. The type of the drive is not of importance, because with a larger dimension of the frame there will be no difficulty to accommodate also the necessary batteries for an electric drive, but also a fluidic drive may be conceived which may be fed, for example, from a pressure accumulator (as indicated at 47 in FIG. 2) extending in longitudinal direction of the frame plane, and/or by a pump.

In a similar manner, the mechanical construction may be adapted to the requirements in a variety of ways. One example can be seen from FIG. 3 where a piston-cylinder-unity 24 is arranged within the hollow interior of the mast 8 and in parallel relationship to it. A piston rod 25 of this unit 24 is connected to the mast 8, and in this embodiment to its head end so that the mast, so to speak forming a prolongation of the unit 24, can be displaced upwardly into the position shown in FIG. 3B. Optionally, a further cylindrical profile may surround the cylinder 24, as is indicated in dash-dotted lines in FIG. 3B. On the other hand, it may be sufficient, if an elastic bellow 40 is provided which covers the cylinder 24 in downwards direction over the dash-dotted length with changing heights of the mast 8 and its sliding bearings 27, 27'. This has, in present case, also the advantage of savings in weight and, thus, of an easier transportation to which end the various parts and profiles may also be formed from light metal.

During this upwards movement, the mast 8 may also guided by a, preferably hollow, rod or pole 26 which engages a sliding bearing 27 at the lower end of the mast 8. To increase stability, this hollow rod 26 can be connected to the cylinder unit 24 by means of a transverse strap 28 located on its top end. Alternatively or in addition, the cylinder 24 may swerve as a sliding guidance, for which reason another bearing 27' could surround the cylinder 24. It is advantageous, if both sliding bearings 27, 27' are provided, to form them integrally so that they can be commonly mounted. A collar 29 of the cylinder 24 may serve both as an area of support for the transverse strap 28 and as a limiting abuttment for the sliding bearing 27'. Similarly, a lower limiting abuttment 30 is provided which is engaged by the sliding bearing 27' in the position shown in FIG. 3A. By these parallelly extending guide members 24 and 26, a certain stiffness against distorsion for the elevating platform 7 is achieved which stiffness isd the greater, the larger the distance between the two guide members 24, 26 is. However, it would also be conceivable to form the two guide members as two guide surfaces spaced apart of a signle body, although this will generally not be preferred.

In an analogous manner, the mast 8 supports also a guide rod 31 for the elevating platform 7 or the platform member 18, respectively. The elevating platform 7 is provided with a sliding bearing 32 that serves with an upper surface 33 as a support for the platform member 18. The platform member 18 a mounting block 34, merely schematically indicated, to which a traction medium 15 (which has alread been described with reference to FIG. 1 as being a chain, but may optionally be formed by a rope or a cable) can be connected. The end of the traction medium 15 which faces the block 34 is suitably provided with a counter-block forming simultaneously the sliding bearing 32 which is equipped with a hook or peg 35 or the like so that the platform meber 18 needs only to have a latching recess 36 for detachably fixing it to the drive and guiding devices of the mast 8 to be able to slide below the peg 35 and to be hooked on with a pivoting motion, then propping against and engaging the surface 33, as already mentioned. In doing this, the reinforcing strut 18' (vide FIG. 2) serves an additional prop element.

The traction medium 15 pases over at least one deviating roll 37, suitably over two, at the top end of the extensible mast 8, and at the other side of the mast 8 through an opening 38 downwards again. The deviating roll(s) 37 may be supported on a vertical rib of the mast 8 freely accessible from above, or, as is apparent from FIG. 1, may be covered by a cap 39 which may optionally be removable. The end of the traction medium 15 which is on the side of the elevating platform 7 passes into the protecting hollow rod 26, for example, to be buffered by a spring (not shown) provided within the hollow rod 26. The spring can be relatively hard so that it is extended only to an unimportant extent with acceptable loads, but with excessive loads is tensioned in such a way that it releases a security switch. Alternatively, the rod 26 may merely serve as a prolongation of the traction medium which is then affixed to its top.

In this way, a kind of hoist or block and tackle is formed allowing a better absorption of the forces acting upon the platform member 18, but also a more favorable construction of the automatic drive unit 24.

Figure 4A:
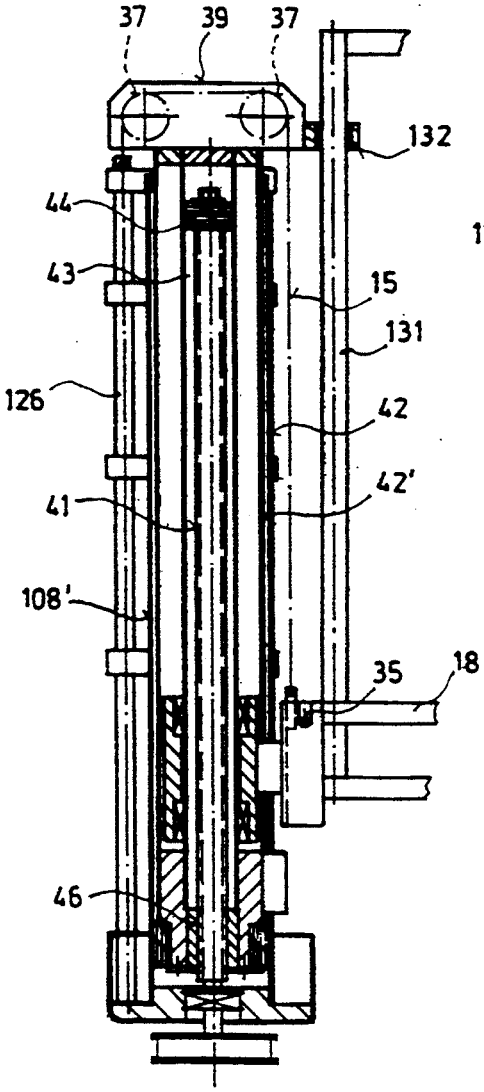
FIGS. 4*a* and 4*b* illustrate another embodiment in similar representations.
Figure 4B:
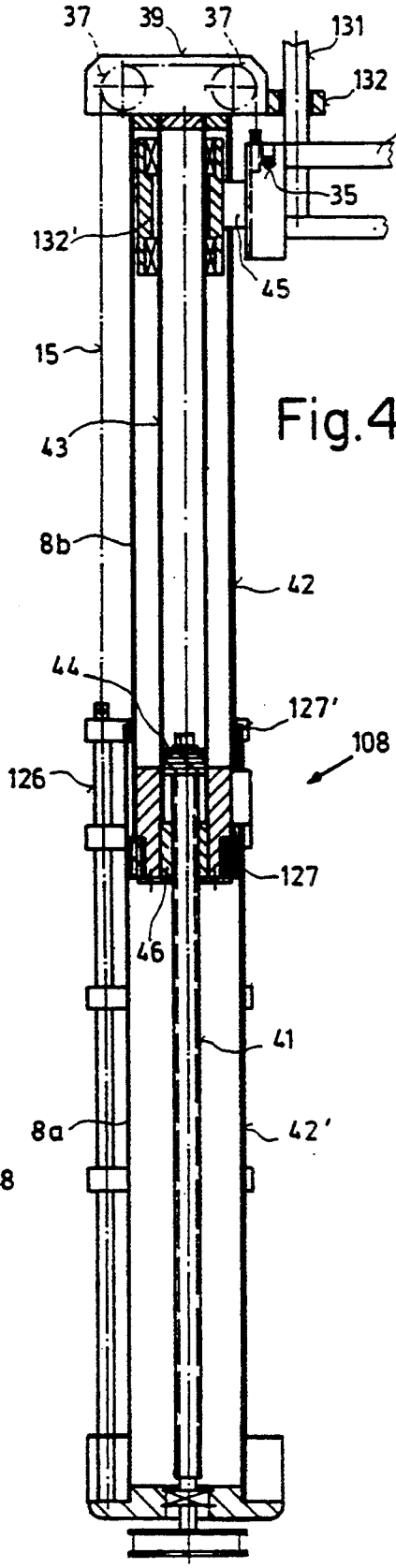

In the case of FIG. 4, instead a fluidic drive, particularly of a pneumatic drive which will comprise a valve (not shown) for shutting off the supply or the discharge of fluid in the respective stop positions of the elevating platform, as is known per se, an electric drive including a threaded spindle is provided. Parts of the same function, as in FIG. 3, have the same reference numerals whereas parts of only a similar function have the same reference numeral, but with a hundred added.

In this embodiment, the mast 108 consists of two tube-sections **8*a*, 8*b* which have a longitudinal slot 42 and 42' each being located on the side facing the platform member 18. The two tube-sections 8*a*, 8*b* can be telescopically slided into one another. Driving motion for the threaded spindle 41 is effeted from below, for example by a motor accommodated in the prism 11, thus, pivoting when the mast 108 is tilted, optionally together with a gear so that a coupling may be omitted. Alternatively, the motor can be mounted on the frame 1 and will be coupled to and will engage a gear part arranged on the prism 11, if the mast 8** assumes its operative position.

The upper tube-like part 8b of the mast 108 has an inner guide tube 43 which slidably surrounds a bearing part 44 at the top end of the threaded spindle 41. This guide tube 43 guides also a sliding bearing 132 for the platform member 18 from which a web 45 projects outwardly through a slot 42 and 42', respectively, and supports the platform member 18 hooked on by means of the peg 35. In this embodiment, the guide rod 131 is affixed to the platform member 18 and passes through a sliding bearing 132 which is secured to the top end of the mast 108 or its cap 39. With such a construction, the guide rod 131 may also be part of the handrail 21, which by the way may be assembled in a similar way as described above, whose transverse portions can be hooked onto the top side of the hollow guide rod 131, for example.

Between the outer tube-section 8*b* and the inner guide tube 43 a sliding bearing 127 or 127' is provided at the bottom side. In this design, the sliding bearing 127 includes a threaded nut portion 46 engaging the threaded spindle 41. In accordance with the rotational direction of the threaded spindle 41, the platform meber 18 will be moved upwards or downwards.

From this explanation, it will become apparaent why a fluidic drive will be preferred in most applications:

it is especially applicable also in rooms where there is a risk of an explosion, particularly when using at least one pressure fluid supply mounted on the frame 1 (the supply being advantageously refilled by means of a recharging appliance outside the elevating appartus);

a fluidic drive is not sellocking as it is the case with a threaded spindle, so that whenever the supply is exhausted, the elevating platform 7 may still be lowered by discharging the lines through a throttle valve (not shown);

it permits also a closed construction of the mast , i.e. without any slot 42, 42' which results in an increased stability and resistance.

In the embodiment of FIG. 4, the hollow rod 126 has no longer a guid function and serves merely to receive the traction medium 15 which, advantageously, also here forms a hoist. However, it is to be understood that more complex forms of hoists having more than one deviatiion may be employed, if desired. Moreover, it will be apparent to those skilled in the art that also other automatic drives can be used than those shown and described. Similarly, other kinds of locking devices, it be for the operating position and/or for the transport position of the mast 8 or 108, may be used. Furthermore, while the preferred embodiment of a mast protruding perpendicularly from the rack 1 in its operating position, it would be also conceivable to construct it as an inclined guidance for an elevating platform riding on it up and dwon. Just then, the parallel arrangement shown of the tilting axis 9 with respect to the beam 3 and in its vicinity is not forcibly necessary. It is evident that also control functions can be assigned to the tilting movement of the mast, for example actuating a security switch (which may be either an electric or a fluidic switch) by which the drive is safely interrupted in the transport position of the mast 8 when it is folded between the beams of the rack 1. Such a function may also be involved with the coupling mentioned above of a frame supported gear part with another gear on the mast.

With reference to FIG. 5, a design is shown in which the tilting axis is made so stable that a separate transverse beam 3 may be ommitted. In this connection, details will be shown which could also be provided in the other embodiments.

The longitudinal beams 2, in this embodiment, have each a transverse tab 49 which may form the bottom of a reversed U-section having two legs 50 (which provides more stiffness while simultaneously also a light weight construction). A bearing block 10' extends preferably over the same length (when seen in the direction of axis 9) as the transverse tab 49 and serves to receive the axle journals 10 in a similar manner as the bearing block 9', visible in FIG. 5C, on the side of the prism. Between the bearing block 10' and the prism 11 and its bearing block 9' a respective washer 51 is arranged for an easy rotation. As best seen in FIG. 1C, the axle journal 10 may optionally comprise a head 52 and is inserted through the bearing blocks 9' and 10' from the inner side of the frame 1. For securing eithera screw may be screwed from outside the frame 1 and the longitudinal beams 2 through a bore into a threaded hole of the axle journal 10, or a cross peg 53 is simply inserted through the axle journal 10 extending into the bearing block 10'. In any case, a transverse connection between the two longitudinal beams 2 is obtained which is sufficiently capable to absorb some possibly occurring forces so that a trasnverse beam 3 (see FIG. 1) may be ommitted.

In this embodiment, the prism 11 is formed as an U-section with inwardly extending edges 54 (FIG. 5C) which hold connecting webs 55 and 56. The respective connecting web 55 serves as a cover for the bearing 9', 10' on either side, while the connecting web 56 supports the parts 24, 26 (vide FIG. 3) which, however, can also be screwn onto the bottom of the prism 11 by means of flanges, as is indicated in dotted lines, and may pass through openings of the web 56 in which case the web 56 serves also as a cover for supply lines or gear parts, if necessary, e.g. for covering a fluid pump (not shown) together with its motor.

According to FIG. 5A, the holder 13 comprise rubber cushions or buffer 57 for supporting the feet 19 of the platform member 18 in its transport position so that a rattle noise caused by the feet on the holder 13 during transport can be avoided. The holder serves, however, also for receiving the locking bar 12, as already described. In this embodiment, the latter is formed as a square rod adjustable in height (with respect to the operating position according to FIG. 5B) and being inserted into the box section 61 of the prism 11. A latch 12' is displaceably inserted into the two hollow ends and may be moved by means of a pin 60 passing through a respective slot 59 from the locking position illustrated into a relase position by displacing it towards the middle of the frame. The latch could also be formed as a round rod for securing at least the locking position, and the pin 60 could be displaced within a slot portion extending transversely to the main potion of the slot 59. In the embodiment shown, however, the construction is chosen in a different manner: the latches 12' have an opening 58 (FIG. 5A) into which a pin 63 passing through the rubber cushion 57 will fall, the pin 63 optionally being adjustable in height by means of an adjusting screw 62.

In order to define the respective end position of the rotating prism, an abuttment arrangement is provided which may be formed, according to this embodiment, by a single threaded bolt 64 (FIG. 5A) having its threaded portion screwed onto the prism 11 and comprising on one side an abuttment head 66 for engagement with the transverse tab 49 (see FIG. 5B). A threaded sleeve 67 is adjustable on the bolt 65 and forms an abuttment surface for an abuttment pin 68. This abuttment pin 68 could be a rigid stop, e.g. supported by a leg 50, but suitably has at least one additional function. Either it forms an actuating pin of a control switch for switching on or off the automatic drive for the movement of the elevating platform 7 in height, as already mentioned, and/or it forms part of a buffering spring system, comprising in particular a gas spring 69. The latter construction is of particular advantage, because a strong torque will act onto the prism 11 during tilting of the mast (with its parts 24, 26) from the operating position, in accordance with FIG. 5B, into the transport position according to FIG. 5A. In addition, without such buffering, there would be the risk of rattle noise arising during transport.

It is evident from the above description that the present invention can be modified in various ways without departing from the scope of the invention; for example, it is apparant that preferably also the platform member 18 has its operating position when connected to the mast as well as a transport position. This is, however, not necessary, because with a relatively short platform it might be folded together with the mast so as to protrude only to a small extent, if any. In this case the platform may be rigidly connected to the moving structure of the mast. On the other hand, it would also be possible to have a folding construction (as is known from ladders) for folding the platform in its transport position in such a manner that it virtually (or completely) is flush with the top plane of the beams 2–4.

What is claimed is:

1. An elevating apparatus comprising:

rack means having an upper surface for providing a support and being of generally rectangular shape so as to have a pair of opposing longitudinal sides and a pair of opposing transverse sides situated substantially perpendicularly to said longitudinal sides, said sides defining a rack plane, said rack including beam means extending long and defining at least three of said sides to form a frame of predetermined height;

mast means pivotally supported with one of their ends by said rack means to be pivoted about a tilting axis from a transport position, in which said mast means are tilted to extend parallely to and within said rack plane, into an operating position in which said mast means assumes a substantially upright position and forms an angle with said rack plane;

means defining said tilting axis to enable said tilting movement of said mast means and to support the same on said rack means, said tilting axis extending within said rack plane and the height of said frame and being arranged parallely to and in close vicinity with one of said transverse sides so as to accommodate at least the major part of said mast means in its transport position between said beam means;

locking means for locking said mast means at least in said operating position;

elevating platform means adapted for guided movement along said mast means when the latter are in operating position; and adjusting means for the position of said elevating platform along said mast means, at least part of said adjusting means being arranged on said mast means.

2. Elevating apparatus as claimed in claim 1, wherein at least two parallel ones of said beams forming said frame have a telescopic construction to enable an extension of said frame.

3. Elevating apparatus as claimed in claim 2, wherein one of said beams forming said frame interconnects said parallel telescopic beams and has a recess forming a cross-section with a projecting portion to engage said mast means when in transport position, thus forming a locking means.

4. Elevating apparatus as claimed in claim 3, wherein said cross-section is U-shaped to receive the end of said mast means averted from said pivoted end.

5. Elevating apparatus as claimed in claim 1, further comprising damping means on said rack means and being arranged so as to engage one surface of said mast means when tilted into transport position.

6. Elevating apparatus as claimed in claim 1, wherein said means defining said tilting axis comprise prism means having a longitudinal axis and including means defining a journal bearing to enable pivoting movement about a pivot axis substantially coincident with said longitudinal axis, said prism means supporting said mast means which extends normally to said prism means.

7. Elevating apparatus as claimed in claim 6, wherein said prism means are quadratic in cross-section.

8. Elevating apparatus as claimed in claim 6, wherein said prism means are hollow, at least in part.

9. Elevating apparatus as claimed in claim 8, wherein at least part of said adjusting means are accommodated within said hollow prism means.

10. Elevating apparatus as claimed in claim 1, wherein said frame is formed by two longitudinally extending beam means and one transverse beam means at one of the ends of said frame, while the opposite transverse side is defined by said means defining said tilting axis, the apparatus further comprising securing means for securing said tilting axis against axial displacement relative to said longitudinally extending beam means.

11. Elevating apparatus as claimed in claim 1, wherein said elevating platform means have a transport position in which at least the major part thereof extends between said beam means, and an operating position in which said platform means extend substantially horizontally and at an angle to said mast means, the apparatus further comprising means defining said positions of the elevating platform means.

12. Elevating apparatus as claimed in claim 11, wherein said frame comprises holding means for said platform means for it holding it in said transport position, said platform means in the transport position forming a plane charging surface together with said upper surface of said rack means.

13. Elevating apparatus as claimed in claim 1, wherein said mast means comprise at least two telescopically extensible parts, one of said parts directly joining said rack means via said tilting axis, said apparatus further comprising extension drive means connected to said directly joining part, whereas the other, extensible part is guided on said directly joining part, and said adjusting means comprising hoist means including a guide pulley mounted on an extensible part of said mast means, and drawing means having two ends, one of them being fixed to said directly joined part, the other end being attached to said platform means at least in said operating position.

14. Elevating apparatus as claimed in claim 1, wherein said mast means comprise displacement guide means for guiding said platform means along the length of said mast means.

15. Elevating apparatus as claimed in claim 14, wherein said displacement guide means comprise at least two elongated guide members extending along the length of said mast means and parallely to each other.

16. Elevating apparatus as claimed in claim 15, wherein said mast means are hollow, and said elongated guide members are spaced from one another within the interior of said hollow mast means.

17. Elevating apparatus as claimed in claim 1, wherein said adjusting means comprise automatic drive means, at least part of them being arranged within the region of said mast means.

18. Elevating apparatus as claimed in claim 17, wherein said mast means are hollow, at least part of said automatic drive means being arranged within said hollow mast means.

19. Elevating apparatus as claimed in claim 17, wherein said automatic drive means are fluidic drive means and comprise piston-and-cylinder means.

20. Elevating apparatus as claimed in claim 19, wherein said fluidic drive means comprise accumulator means for storing an amount of fluidic medium to drive said piston-and-cylinder means.

21. Elevating apparatus as claimed in claim 19, wherein the cylinder of said piston-and-cylinder means has an outer surface extending lengthwise of said mast means, the apparatus further comprising a displacement guide member for engagement with said outer surface.

22. Elevating apparatus as claimed in claim 21, wherein said mast means comprise at least two telescopically extensible parts, said displacement guide member is attached to one of said parts.

23. Elevating apparatus as claimed in claim 1, wherein said mast means comprise a single tiltable pole.

24. Elevating apparatus as claimed in claim 1, wherein said adusting means and said elevating platform means comprise detachable mounting means for detachably connecting said platform means to said adjusting means.

25. Elevating apparatus as claimed in claim 24, wherein said detachable mounting means comprise two-part hook means and a pair of abuttment surfaces situated below said hook means when said mast means together with said platform means are in operating position, one of said parts and surfaces being respectively arranged on said moving means, while the other part and surface is located on said platform means.

* * * * *